United States Patent [19]

Kudo et al.

[11] Patent Number: 4,810,997

[45] Date of Patent: Mar. 7, 1989

[54] SMALL SOUND GENERATING DEVICE

[75] Inventors: Yasuhito Kudo; Tsuneyuki Otsubo, both of Nagano, Japan

[73] Assignee: Kabushiki Kaisha Sankyo Seiki Seisakusho, Nagano, Japan

[21] Appl. No.: 841,966

[22] Filed: Mar. 20, 1986

[51] Int. Cl.[4] ..... G08B 3/00

[52] U.S. Cl. ..... 340/384 E; 340/384 R; 381/90; 446/297

[58] Field of Search ..... 340/384 E, 384 R, 402, 340/693; 446/297, 303, 397, 404; 273/1 E; 368/250, 255, 69, 70, 319–321; 200/159 B, 292, 340; 84/1.03, DIG. 24; 310/322, 324; 181/156; 381/90, 190, 111, 114, 205

[56] References Cited

U.S. PATENT DOCUMENTS

| | | | |
|---|---|---|---|
| 3,932,868 | 1/1976 | Saitou | 340/384 R |
| 3,996,429 | 12/1976 | Chu et al. | 200/159 B |
| 4,210,223 | 7/1980 | Gillum | 181/156 |
| 4,245,218 | 1/1981 | Berkebile et al. | 340/693 |
| 4,249,338 | 2/1981 | Wexler | 446/303 |
| 4,263,485 | 4/1981 | Corwin | 200/292 |
| 4,537,109 | 8/1985 | Sakurai | 84/1.18 |
| 4,597,099 | 6/1986 | Sawafuji | 381/90 |
| 4,604,606 | 8/1986 | Sweany | 340/384 E |

FOREIGN PATENT DOCUMENTS

| | | |
|---|---|---|
| 0120865 | 8/1985 | Japan . |
| 0131795 | 9/1985 | Japan . |

*Primary Examiner*—John W. Caldwell, Sr.
*Assistant Examiner*—Edwin C. Holloway, III
*Attorney, Agent, or Firm*—Sughrue, Mion, Zinn, Macpeak & Seas

[57] ABSTRACT

A small sound generating device such as may be incorporated into a child's stuffed doll or the like. The device includes a cover having a sound radiating hole formed therein, a holding plate, a sound generating element supported between the cover and the holding plate, a touch plate case, and a circuit board supported between the rear side of the holding plate and the touch plate case. A contact switch is provided on the rear side of the circuit board, and the touch plate of the contact switch is exposed through a window formed in the touch plate case.

11 Claims, 4 Drawing Sheets

SMALL SOUND GENERATING DEVICE

BACKGROUND OF THE INVENTION

The present invention relates to a sound generating device which is relatively small in size and is adapted to be incorporated in a stuffed doll or the like.

Recently, there has been a strong demand for the provision of toys such as stuffed dolls in which electronic sound generating devices are incorporated. Such electronic sound generating devices must be mechanically rugged to withstand children's rough handling of the toys, and furthermore the devices should be easy to operate and small in size.

An electronic sound generating device having a control switch formed of electrically conductive rubber contacts and which is mounted in a plastic case has been disclosed by Japanese Utility Model Application No. 8269/1984 filed by the instant applicant. Furthermore, a unit has been proposed which is obtained by assembling a reed switch (such as disclosed by Japanese Laid-Open Utility Model Application No. 131795/1984), a protective cover, a melody playing element, a loudspeaker, mounting plates, etc. The former is generally not suitable for stuffed dolls or the like because the switch operating part is relatively small and hence cannot be readily operated from the outside. In addition, the device is relatively large in size and low in mechanical strength. On the other hand, in the case of the latter device using the reed switch, the reed switch cannot be turned on by merely applying pressure to it; that is, in order to operate the reed switch, it is necessary to move a magnet. Thus, the application of the latter unit is limited. That is, as the magnet must be provided in addition to the other parts of the device, it is unsuitable for use in stuffed dolls and the like. Also, the switch has a low power handling capability. Furthermore, assembling the unit itself is rather difficult.

SUMMARY OF THE INVENTION

In view of the foregoing difficulties, an object of the invention is to provide a small sound generating device which can be readily miniaturized and is mechanically sufficiently strong as to be able to withstand rough handling by young children, which is constructed of only a small number of components, which has a switch which is easy to operate, and which can operate stably when used in a stuffed doll or the like.

Another object of the invention is to provide a small sound generating device having a switch which can be readily operated with a small depression force.

In a small sound generating device according to the invention, an annular step is formed in the cylindrical wall of the circular recess of a cover having a sound radiating hole, a sound generating element such as a piezoelectric buzzer or the like is mounted on the annular step, a holding plate having an annular projection abutted against the periphery of the sound generating element is engaged with the cover to retain the sound generating element, a circuit board supporting part is formed on the rear side of the holding plate, a circuit board on the rear side of which a contact switch is provided is mounted on the circuit board supporting part in such a manner that the circuit side thereof confronts the circuit board supporting part, a touch plate case having a circuit board holding part is engaged with the holding plate on the cover to assemble the cove,, sound generating element, holding plate, circuit board, and touch plate case into one unit, and the sound generating element is electrically connected to the circuit board through conductors extending through a cut or hole in the holding plate.

BRIEF DESCRIPTION OF THE DRAWINGS

FIG. 14 is an exploded view showing the electrical connection between the circuit and the sound generating element; and FIG. 15 is a schematic showing the electrical connections of the device.

DESCRIPTION OF THE PREFERRED EMBODIMENTS

A first embodiment of the invention will be described with reference to FIGS. 1 through 3.

Figure 1:
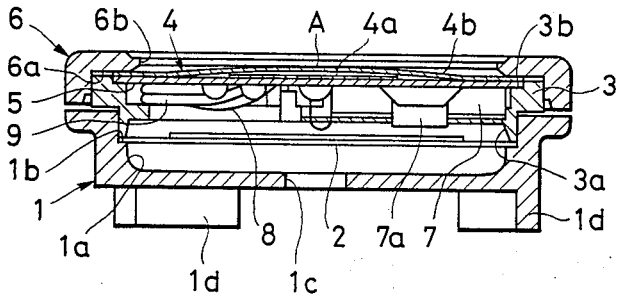
FIG. 1 is a sectional side view of a small sound generating device a first embodiment of this invention.
Figure 2:
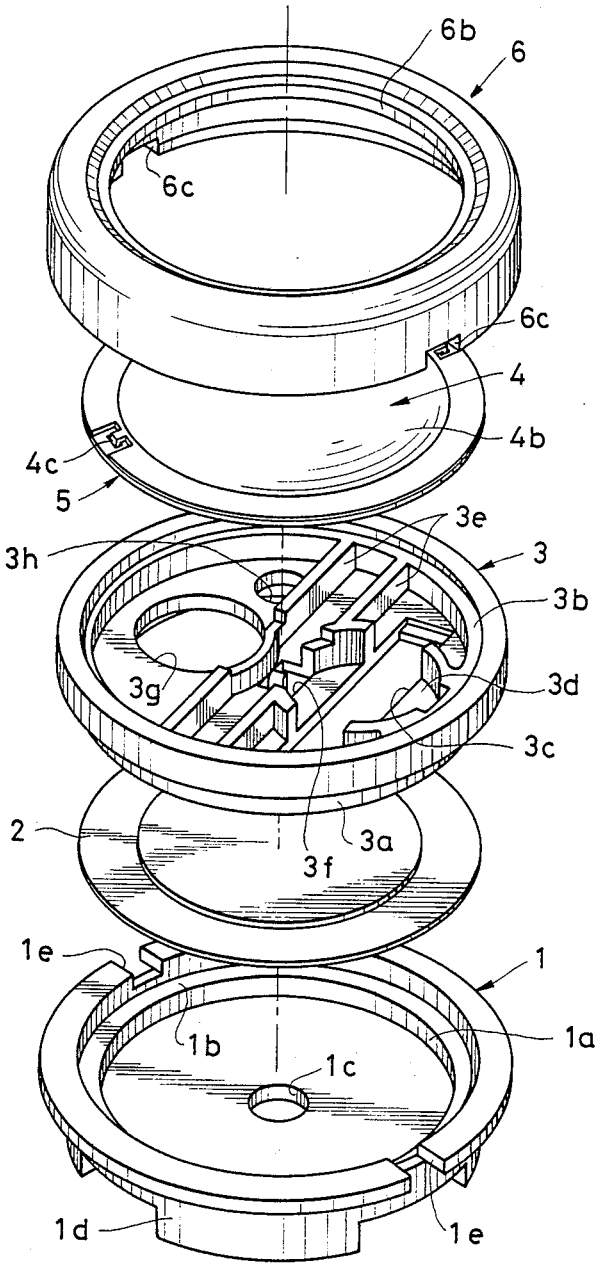
FIG. 2 is an exploded perspective view of the device shown in FIG. 1.

As shown in FIGS. 1 and 2, in a small sound generating device, a cover 1 made of synthetic resin has a cylindrical recess 1*a* defined by a cylindrical wall in which an annular step 1*b* is formed. A thin sound generating element 2 such as a piezoelectric buzzer is set on the annular step 1*b*. A holding plate 3, also made of synthetic resin, is placed on the sound generating element 2. An annular protrusion 3*a* of the holding plate is engaged with the cover 1 in such a manner as to abut against the periphery of the sound generating element 2, thereby to retain the latter. An annular-step-shaped circuit board supporting part 3*b* is formed on the rear side of the holding plate 3. A circular circuit board 5 on the rear side of which a contact switch 4 is mounted is set on the rear side of the circuit board supporting part 3*b* in such a manner that its circuit side confronts the rear side of the supporting part 3*b*. An annular touch plate case 6 made of synthetic resin is placed on the circuit board 5 and fitted on the outer wall of the holding plate 3.

A sound radiating hole 1*c* is formed in the circular recess la of the cover 1 at the center. Four legs 1*d* protrude from the periphery of the outer end face of the cover 1 so that, when the sound generating device is incorporated into a stuffed doll or toy, the sound radiating hole 1*c* will not be clogged. Grooves 1*e* and 1*e* are formed in the peripheral flange of the cover 1. A solvent or adhesive of low viscosity is poured into the grooves 1*e* to fixedly join the cover 1, the holding plate 3, and the touch late case 6 together.

A rectangular through-hole 3*c* and a circular recess 3*d*, which together serve as a battery accommodating section, central reinforcing ribs 3*e*, a square through-hole 3*f*, a relief hole 3*g* for an electronic component 8, and a through-hole 3*h* for a cable 9 of lead wires are formed in the inside of the circuit board supporting part 3*b* of the holding plate.

The contact switch 4 has a stationary contact 4*a* fixedly secured to the rear side of the circuit board 5, a conductive touch plate 4*b* having an operating surface A which is upwardly curved to cover the stationary contact 4*a*, and two lugs 4*c* protruding from the periphery thereof. The two lugs 4*c* are soldered through holes to the circuit pattern on the circuit side of the circuit board 5. That is, the stationary contact 4*a* and the lugs 4*c* of the conductive touch plate are electrically connected to the circuit pattern of the circuit board 5 so that substantially the whole region of the rear side of the circuit board 5 forms the contact switch 4. On the circuit side of the circuit board 5, as shown in FIG. 3, a holder 7*a* for a battery 7 and an electronic component 8 are fixedly provided, and the circuit board 5 is connected to the sound generating element 2 via the cable 9, which extends through the hole 3*h* of the holding plate 3.

The annular touch plate case 6 has a planar depressing part 6*a* which is adapted to depress the periphery of the circuit board 5 against the circuit board supporting part 3*b* of the holding plate. The large circular through-hole 6*b* of the touch plate case 6 sufficiently exposes the conductive touch plate 4*b*, which forms the operating surface of the contact switch 4. Two grooves 6*c* are formed in the cylindrical wall of the annular touch plate case 6.

The cover 1, the holding plate 3, and the touch plate case 6 are assembled as described above, and then solvent or adhesive is dropped into the grooves 1*e* and 6*c* and allowed to circulate throughout the joint by capillary action to fixedly join these parts together.

The operation of the small sound generating device thus constructed is as follows:

When the curved operating surface A is depressed, the inside of the conductive touch plate 4*b* is brought into contact with the stationary contact 4*a*; that is, the contact switch 4 is turned on such that current is applied to the electronic component 8 so that the sound generating element 2 outputs a musical sound or the like.

In the small sound generating device thus constructed, the operating surface A of the contact switch 4 is exposed through the relatively wide circular hole 6*b* of the touch plate case 6. Therefore, even if the device is incorporated into a stuffed doll or the like, the switch can be readily operated, and the switch is protected from the entrance of dust or the like and is therefore stable in operation. Furthermore, the resistance force of the switch is sufficiently high against the force of depression.

The small sound generating device of the invention can be readily constructed by assembling the cover 1, the sound generating element 2, the holding plate 3, the circuit board 5, and the touch plate case 6 in the stated order. That is, the device has a very good assembly efficiency. The cover 1, the holding plate 3, and the touch plate case 6 are uniform in mechanical strength, both being made of synthetic resin. The cover, the sound generating element, the holding plate, the circuit board, and the touch plate case are joined into one unit. Therefore, the small sound generating device of the invention can be built into a stuffed doll or the like without using additional parts.

The cover 1, the holding plate 3, and the touch plate case 6 may be softly press-fitted together depending on the intended use of the device. The cover 1 may be engaged directly with the touch plate case 6 as the case may be. Also, the legs 1*d* may be removed from the cover 1 depending on the intended use of the device.

In the above-described embodiment, the lead wires of the cable 9 are employed for making the necessary electrical connections. However, the lead wires may be replaced by coil springs. In this case, the soldering of the lead wires is eliminated. That is, the coil springs in their compressed state are positioned by the hole 3*h* of the holding plate 3. The hole 3*h* may be replaced by a slot.

A second embodiment of the invention, namely, a small sound generating device which is operated by a small force of depression, will be described with reference to FIGS. 4 through 8.

Figure 4:
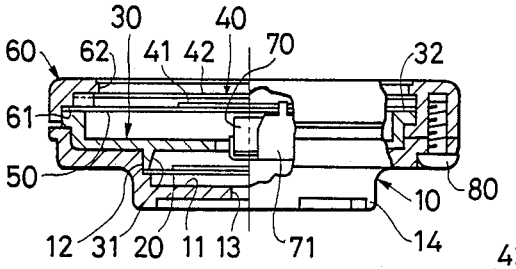
FIG. 4 is a sectional side view of a small sound generating device of a second embodiment of the invention.
Figure 5:
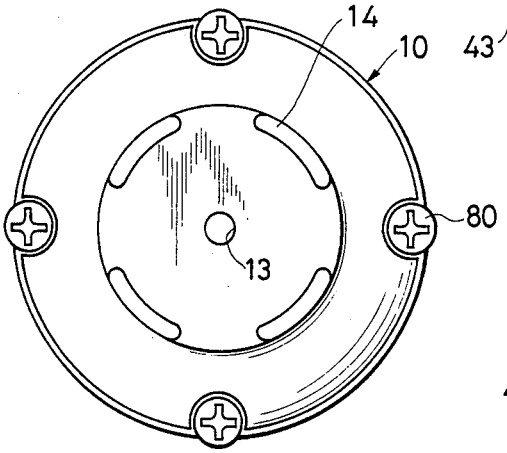
FIG. 5 is a bottom view of the device shown in FIG. 4.
Figure 6:
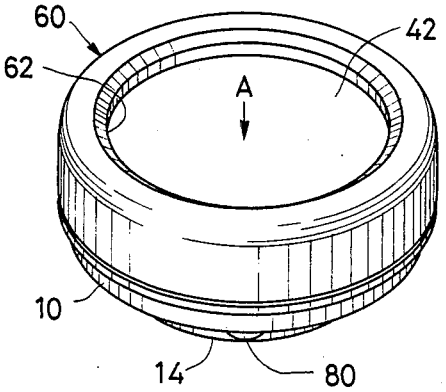
FIG. 6 is an external perspective view of the device shown in FIG. 4.

As shown in FIGS. 4 through 6, in a small sound generating device of the second embodiment of the invention, the cover 10 made of synthetic resin has a circular recess 11 in its cylindrical wall in which an annular step 12 is formed. A thin sound generating element 20 such as piezoelectric buzzer is set on the annular step 12. A holding plate 30 of synthetic resin is placed on the sound generating element 20. The annular protrusion 31 of the holding plate 30 is engaged with the cover 10 in such a manner as to abut against the periphery of the sound generating element 20, thereby to retain the latter. An annular step-shaped circuit board supporting part 32 is formed on the rear side of the holding plate 30. A circular circuit board 50 on the rear side of which a contact switch 40 is mounted is set on the rear side of the circuit board supporting part 32 in such a manner that its circuit side confronts the rear side of the supporting part 32. An annular touch plate case 60, also made of synthetic resin, is placed on the circuit board 50 and fitted on the outer wall of the holding plate 30. The cover 10 is fixedly secured to the touch plate case 60 with screws 70. For this purpose, the peripheries of the holding plate 30, the contact switch 40, and the circuit board 50 are threaded to receive the screws.

A sound radiating hole 13 is formed in the circular recess 11 of the cover 10 at the center. Four legs 14 protrude from the periphery of the outer end face of the cover 10 so that the sound radiating hole 13 cannot be clogged.

Figure 7:
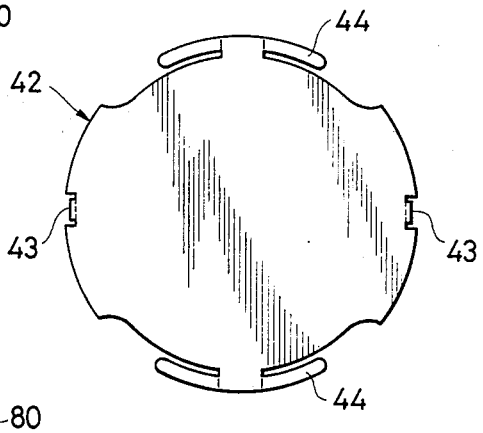
FIG. 7 is a plan view of a touch plate in the device of FIG. 4.
Figure 8:
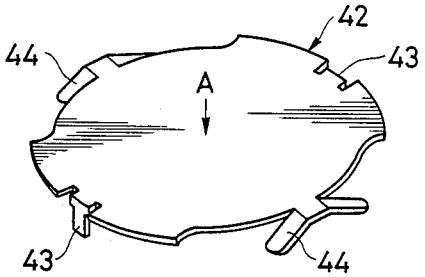
FIG. 8 is a perspective view of the touch plate.

The contact switch 40 has a stationary contact 41 fixedly secured to the rear side of the circuit board 50 and a conductive touch plate 42 which is held on the rear side of the circuit board 50 in such a manner that it is spaced from the stationary contact 41. The touch plate 42, as shown in FIGS. 7 and 8, includes a planar operating surface A, a plurality of fixing lugs 43 bent towards the circuit board 50, and a plurality of elastic lugs 44 which are bent towards the circuit board 50. When no load is applied to the touch plate 42, the gap between the touch plate 42 and the stationary contact 41 is maintained unchanged by means of the lugs 43 and 44. The lugs of the stationary contact 41 and the lugs 43 of the touch plate 42 extend through holes in the circuit board 50 and are soldered to the circuit pattern on the circuit side of the circuit board 50. Therefore, substantially the whole region of the rear side of the circuit board forms the contact switch 40. On the circuit side of the circuit board 50, as shown in FIG. 4, a holder 71 for a battery 70 and an electronic component (not shown) are fixedly provided, and the circuit board 50 is connected to the sound generating element 20 through lead wires.

The aforementioned annular touch plate case 60 has a planar depressing part 61 which is adapted to depress the periphery of the circuit board 50 against the circuit board supporting part 32 of the holding plate 30. The annular touch plate case 60 has a large circular hole 62 through which the operating surface A of the touch plate 42 of the contact switch 40 is exposed.

The operation of the small sound generating device of the second embodiment of the invention, is as follows:

When the operating surface of the touch plate 42 is depressed, the elastic lugs 44 are opened while the touch plate 42 is bent so that the inner surface of the touch plate 42 is brought into contact with the stationary contact 41; that is, the contact switch 40 is turned on to thereby energize the electronic component. As a result, the sound generating element 20 outputs musical sound or the like.

In the small sound generating device of the invention constructed as described above, the operating surface A of the touch plate 42 of the switch 40 is planar, and the touch plate 42 has a plurality of fixing lugs 43 and a plurality of elastic lugs 44 along the periphery. Due to this construction, the touch plate can be easily manufactured. As the touch plate 42 is mounted on the circuit board 50 through its lugs 43 and 44, the gap between the touch plate and the stationary plate is correctly maintained when no load is applied to the touch plate. When the operating surface A is depressed, the touch plate 42 is bent, and accordingly the elastic lugs 44 are deformed while sliding on the circuit board 50. Therefore, the load of depression is small; that is, the switch can be readily operated even by an infant. Furthermore, even if the touch plate 42 and the circuit board 50 are held down by the touch plate case 60, no stress is applied to the planar operating surface A of the touch plate 42, and therefore the load of depression is not increased. Furthermore, because the operating surface of the touch plate 42 is exposed over a wide area through the large circular hole 62 of the touch plate case 60, even if the device is built into a stuffed doll or the like, the switch can be readily operated. In addition, the aforementioned gap between the touch plate and the stationary contact is maintained unchanged by the lugs 43 and 44 when no load is applied to the touch plate. Accordingly, the switch of the small sound generating device can be positively turned on and off.

The load of depression of the touch plate 42 can be determined as desired by changing the width and the thickness of the elastic lugs 44. The cover 10, the holding plate 30, and the touch plate case 60 may be softly press-fitted together. Alternatively, the cover 10 may be engaged directly with the touch plate case 60. Also, the legs 14 of the cover 10 may be eliminated, depending on the intended use of the device.

In the above-described second embodiment, the circuit board 50 is connected through the lead wires to the sound generating element 20. However, as before, the lead wires may be replaced by coil springs. In this case, the soldering of the lead wires is eliminated. That is, the coil springs in their compressed state are positioned by the hole formed in the holding plate so that the springs are prevented from being dislodged.

Figure 9:
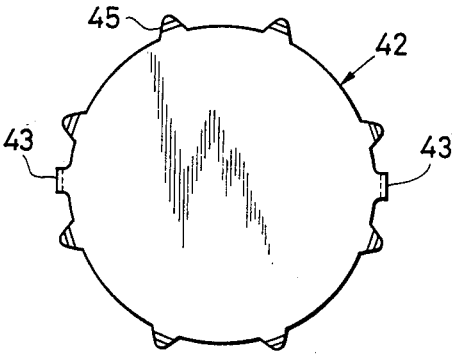
FIG. 9 is a plan view of another example of the touch plate.
Figure 10:
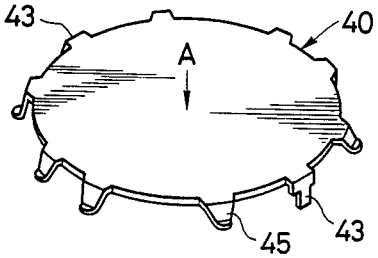
FIG. 10 is a perspective view of the touch plate in FIG. 9.

FIGS. 9 and 10 show a modification of the touch plate 42. The touch plate 42 in FIGS. 9 and 10 includes a planar operating plate A, a plurality of fixing lugs 43, and a plurality of elastic lugs 45 which extend from the periphery of the operating plate A and are bent towards the circuit board so that a predetermined gap is maintained between the stationary contact 41 and the touch plate 42 when no load is applied to the touch plate 42.

When the operating surface A is depressed, the elastic lugs mounted on the rear side of the circuit board are deformed in such a manner as to open radially outwardly, as a result of which the inner surface of the touch plate 42 is brought into contact with the stationary contact 41. FIG. 9 shows eight elastic lugs 45; however, the number of elastic lugs may be reduced to two.

An application of the invention in which sound is radiated in opposite directions will be described with reference to FIGS. 11 through 13.

Figure 3:
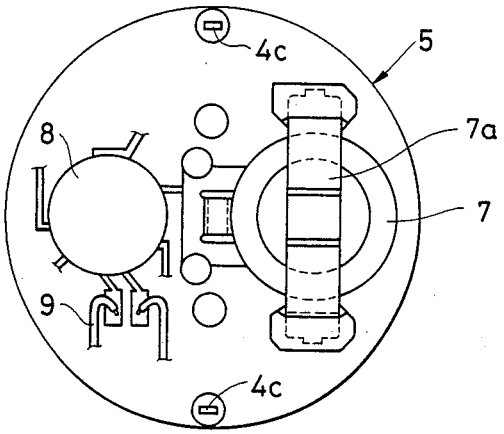
FIG. 3 is a plan view showing the arrangement of electronic components on the circuit side of a circuit board.

In this application, the small sound generating device described with reference to FIGS. 1 through 3 is employed, and a sound radiating structure for the device is provided as follows: As shown in FIGS. 11 through 13, the legs **1*d* protruding from the outer end face of the synthetic resin cover 1 of the small sound generating device are fixedly inserted into grooves 92 in the bottom 91 of a cup-shaped reflector 90. The opening 93 of the cup-shaped reflector 90 is larger in diameter than the annular touch plate case 6. Mounting protrusions 94 having holes 95 extend from the opening 93 of the cup-shaped reflector 90**.

When the operating surface A of the touch plate **4*b* is depressed, the inner surface of the latter is brought into contact with the stationary contact 4*a*; that is, the switch 4 is turned on to energize the electronic component 8. As a result, the sound generating element 2 outputs musical sound or the like. The sound radiated through the sound radiating hole 1*c*, reflected by the bottom 91 of the cup-shaped reflector 90, propagates towards the contact switch 4 passing through the gaps between the legs 1*c***.

In the sound radiating structure formed as described above, the sound generated by the sound generating element 2 propagates forwardly due to the presence of the cup-shaped reflector 90. Therefore, the sound radiation effect is remarkably improved. Furthermore, as the operating surface A of the switch 4 is exposed over a wide area through the large circular hole **6*b* of the touch plate case 6**, even if the device is built into a stuffed doll or the like, the switch can be readily and positively turned on and off.

The cup-shaped reflector 90, the cover 1, the holding plate 3, and the touch plate case 6 may be softly press fitted or fixedly joined together with screws depending on the intended use of the device.

With the small sound generating device constructed as described above, the operating surface of the contact switch is exposed over a wide area through the large circular hole of the touch plate case. Therefore, even if the device is built into a stuffed doll or the like, the switch can be readily and positively turned on and off. The switch is protected from the entrance of dust or the like and is therefore stable in operation. Furthermore, the switch is sufficiently durable against depression forces. In addition, since the device can be formed by assembling its components one after another, the device has a good assembly efficiency and high mechanical strength. As the device is small in size, it can easily be incorporated into a stuffed doll or the like without using additional parts.

In the devices shown in FIGS. 4 through 10, the gap between the touch plate and the stationary contact is positively maintained constant by means of the lugs when no load is applied to the touch plate, and the switch can be turned on with a small load of depression.

Figure 13:
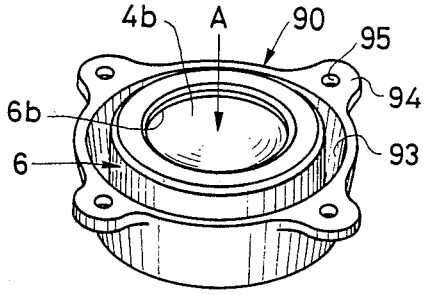
FIGS. 12 and 13 are, respectively, a plan view and a perspective view of the arrangement of FIG. 11.
Figure 11:
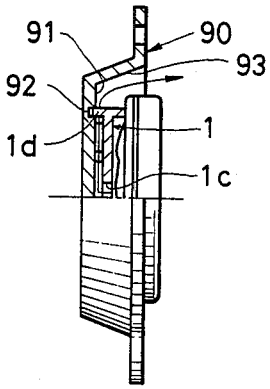
FIG. 11 is a sectional side view depicting an application of the small sound generating device according to the invention in which the sound generated is radiated in opposed directions.
Figure 12:
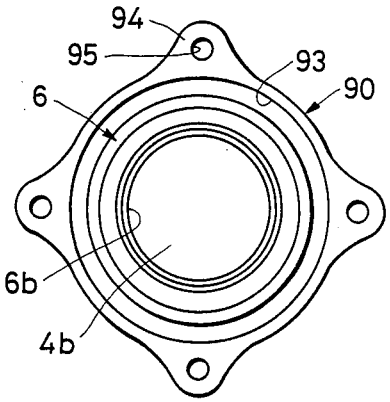

In the application of the device shown in FIGS. 11 through 13, the sound is reflected by the bottom of the cup-shaped reflector towards the switch. That is, the sound pressure is increased by the reflection, which improves the sound radiation effect.

We claim:

1. A small sound generating device comprising:

a cover (1) having therein a sound radiating hole (1*c*), a cylindrical wall defining a circular recess (1*a*), and an annular step (1*b*) formed in said cylindrical wall;

a holding plate (3) having an annular step-shaped circuit board supporting part (3*b*) on a first side thereof and an annular projection (3*a*) opposite said first side;

a sound generating element (2) supported between said annular step (1*b*) of said cover and said annular projection (3*a*) of said holding plate;

a touch plate case (6) having a circuit board holding part (6*a*) and a through hole;

a circuit board (5) supported between said circuit board holding part (6*a*) of said touch plate case (6) and said circuit board supporting part (3*b*) of said holding plate (3), wherein the circuit side of said circuit board (5) confronts said circuit board support part (3*b*);

a contact switch (4) provided on a first side of said circuit board (5), said contact switch (4) having a movable touch plate (4*b*) with at least one lug (4*c*) protruding therefrom, said lug being electrically connected to said circuit side of said circuit board, and a stationary contact fixedly secured to said first side of said circuit board (5) and confronting said movable touch plate (4*b*);

means for connecting said cover (1), said holding plate (3), and said touch plate case (6), whereby said sound generating device (2) is retained between said cover (1) and said holding plate (3), and said circuit board (5) is retained between said holding plate (3) and said touch plate case (6); and means for electrically connecting said stationary contact, said circuit board and said sound generating element.

2. The device as claimed in claim 1, in which:

said sound generating element comprises a piezoelectric buzzer; and wherein said means for electrically connecting said sound generating element to said circuit board, comprises conductors extending through a hole formed in said holding plate.

3. The device as claimed in claim 1, in which at least one lug protrudes from the periphery of said movable touch plate, said lug extending through said circuit board and being electrically connected to a circuit on said circuit board.

4. The device as claimed in claim 1, in which said touch plate comprises an outwardly curved plate.

5. The device as claimed in claim 1, in which said tough plate comprises a flat plate having a plurality of elastic lugs on the periphery thereof, ends of said elastic lugs abutting against said first side of said circuit board.

6. The device as claimed in claim 1, in which said touch plate case and said cover are joined together with adhesive.

7. The device as claimed in claim 1, in which said touch plate case and said cover are joined together with screws.

8. The device as claimed in claim 1, further comprising a cup-shaped reflector having an opening larger than said cover secured to said cover with said sound radiating hole confronting said cup-shaped reflector.

9. The device as claimed in claim 8, in which said cover has legs, said cup-shaped reflector being secured to said cover through said legs.

10. A small sound generating device comprising:

a circuit board having, on one side, a circuit and a battery, and, on the other side, a stationary contact and an outwardly curved movable touch plate, said movable touch plate having an outer peripheral portion in contact with a surface of said circuit board, said outer peripheral portion being held in a fixed manner;

a sound generating element in the form of a thin plate;

electrical connecting means for connecting said stationary contact, said circuit board and said sound generating element; and a casing for positioning said circuit board adjacent said sound generating element and for surrounding said outer peripheral portion of said movable contact plate, said movable contact plate being exposed, said casing having a sound releasing hole and enclosing said sound generating element except for said sound releasing hole.

11. The device according to claim 10, wherein projections are provided radially outwardly of said sound releasing hole in said casing.

* * * * *